US009353539B2

(12) United States Patent
Shebek et al.

(10) Patent No.: US 9,353,539 B2
(45) Date of Patent: May 31, 2016

(54) APPARATUS FOR AUTOMATIC COVER ASSEMBLY

(71) Applicants: Automatic Pool Covers, Inc., Westfield, IN (US); Poolsafe, Inc., Escondido, CA (US)

(72) Inventors: Michael J. Shebek, Carmel, IN (US); Patrick E. Callahan, Escondido, CA (US)

(73) Assignees: Automatic Pool Covers, Inc., Westfield, IN (US); Poolsafe, Inc., Escondido, CA (US)

( * ) Notice: Subject to any disclaimer, the term of this patent is extended or adjusted under 35 U.S.C. 154(b) by 292 days.

(21) Appl. No.: 14/046,334

(22) Filed: Oct. 4, 2013

(65) Prior Publication Data

US 2015/0096115 A1 Apr. 9, 2015

(51) Int. Cl.
*E04H 4/00* (2006.01)
*E04H 4/10* (2006.01)
*E04H 4/08* (2006.01)

(52) U.S. Cl.
CPC ..... *E04H 4/101* (2013.01); *E04H 4/00* (2013.01); *E04H 4/082* (2013.01); *Y10T 29/49826* (2015.01); *Y10T 29/49959* (2015.01)

(58) Field of Classification Search
CPC ..... E04H 4/084
USPC ..... 4/488–513; 482/55; 29/428
See application file for complete search history.

(56) References Cited

U.S. PATENT DOCUMENTS 3,050,743 A * 8/1962 Lamb ..... E04H 4/101 135/903
4,686,717 A * 8/1987 MacDonald ..... E04H 4/101 4/502
4,811,433 A * 3/1989 MacDonald ..... E04H 4/101 4/502
4,815,152 A * 3/1989 MacDonald ..... E04H 4/101 4/498
4,858,253 A * 8/1989 Lamb ..... E04H 4/101 4/502
5,044,022 A * 9/1991 Hess ..... E04H 4/101 4/502
5,105,481 A 4/1992 Lamb et al.
5,524,302 A * 6/1996 Ragsdale ..... E04H 4/101 242/388.8
5,913,613 A * 6/1999 Ragsdale ..... E04H 4/101 4/498
5,920,922 A * 7/1999 Ragsdale ..... E04H 4/101 4/498
6,431,488 B1 * 8/2002 Zemla ..... E04H 4/101 242/388.6
8,418,280 B2 * 4/2013 Schwerzmann ..... E04H 4/082 242/390.8
2007/0256230 A1 * 11/2007 Phizackerley ..... B66D 1/38 4/502
2008/0135579 A1 * 6/2008 Bertram ..... B29B 7/7438 222/145.5
2010/0018825 A1 * 1/2010 Claeys ..... B41F 23/0409 192/56.62
2010/0199417 A1 8/2010 Shebek
2014/0000021 A1 * 1/2014 Scheps ..... E04H 4/101 4/498

* cited by examiner

*Primary Examiner* — Lori Baker
(74) *Attorney, Agent, or Firm* — Taylor IP, P.C.

(57) ABSTRACT

A cover assembly for covering a container of liquid includes: a drive shaft including a drive pin; an engagement device configured for moving axially on the drive shaft when the drive pin engages the engagement device, the engagement device including at least one first engagement mechanism; and a first engagement hub rotatably mounted to the drive shaft and configured for being driven by the engagement device, the first engagement hub including at least one second engagement mechanism which includes at least one magnet configured for pulling the at least one first engagement mechanism and thereby for facilitating an engagement of the at least one first engagement mechanism with said at least one second engagement mechanism.

14 Claims, 7 Drawing Sheets

APPARATUS FOR AUTOMATIC COVER ASSEMBLY

BACKGROUND OF THE INVENTION

1. Field of the Invention

The present invention relates to containers of liquid such as swimming pools, hot tubs, spas, swim spas, and the like, and, more particularly, to automatic cover assemblies for such containers.

2. Description of the Related Art

Swimming pools, for example, are commonly covered to prevent debris from entering the pool, to preserve chemical treatments in the water and to heat the pool in the case of a solar cover. An automatic pool cover provides convenience for a user by allowing the cover to be easily extended over the pool during periods of non-use, and retracted during periods of use. Typically, a pool cover box is placed in or on the decking surrounding the swimming pool at a location opposite from the walk-in steps (i.e., usually located at the deep end of the pool). The pool cover box extends across the width of the swimming pool, and within the box is mounted a reel (which can be referred to as a drum) to store the pool cover on, an electric (or hydraulic) motor, and a mechanism to deploy and retract the pool cover.

A drive mechanism for driving the extension and retraction of the pool cover is known. Such a drive mechanism can be a spiral-jaw clutch system including a double driver member having a diagonal cam slot, an end member associated with a cover drum, and an end member associated with a reel. One problem with such a drive mechanism is that the double driver member must be mounted to a drive shaft in a specific orientation depending upon whether a motor-left or a motor-right orientation is used.

What is needed in the art is a drive device that selectively effects a positive engagement with a driven end members and that can be used as a universal drive device regardless of whether a motor-left or a motor-right orientation is used.

SUMMARY OF THE INVENTION

The present invention provides an engagement device with axial pins that engage holes in the driven end members, the engagement device configured for being mounted on a drive shaft in either direction and still being used with either a motor-left or a motor-right orientation.

The invention in one form is directed to a cover assembly for covering a container of liquid which includes: a drive shaft including a drive pin; an engagement device configured for moving axially on the drive shaft when the drive pin engages the engagement device, the engagement device including at least one first engagement mechanism; and a first engagement hub rotatably mounted to the drive shaft and configured for being driven by the engagement device, the first engagement hub including at least one second engagement mechanism which includes at least one magnet configured for pulling the at least one first engagement mechanism and thereby for facilitating an engagement of the at least one first engagement mechanism with said at least one second engagement mechanism.

The invention in another form is directed to a cover assembly for covering a container of liquid. The covering assembly includes: a drive shaft including a drive pin; a first engagement hub rotatably mounted to the drive shaft, the first engagement hub including a first hole; and an engagement device configured for moving axially on the drive shaft when the drive pin engages the engagement device, the engagement device including an axially extending first pin which is configured for engaging the first hole and thereby for driving the first engagement hub.

The invention in yet another form is directed to a method for using a cover assembly for covering a container of liquid which includes the steps of: providing a drive shaft, an engagement device, and a first engagement hub, the drive shaft including a drive pin, the first engagement hub being rotatably mounted to the drive shaft; moving axially the engagement device on the drive shaft when the drive pin engages the engagement device, the engagement device including at least one first engagement mechanism; driving, using the engagement device, the first engagement hub, the first engagement hub including at least one second engagement mechanism which includes at least one magnet; pulling, using the at least one magnet, the at least one first engagement mechanism and thereby facilitating an engagement of the at least one first engagement mechanism with the at least one second engagement mechanism.

An advantage of the present invention is it provides an apparatus for retracting and extending a pool cover over a swimming pool.

Another advantage is that it provides magnets in engagement holes so as to effect a positive engagement with corresponding pins, thereby providing a smooth engagement and disengagement of the pins from the holes.

Yet another advantage is that it provides an engagement device which can be used as a universal engagement device without regard to whether a motor-left or a motor-right orientation is used, the installer not having to orient the engagement device in any specific axial orientation on the drive shaft.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
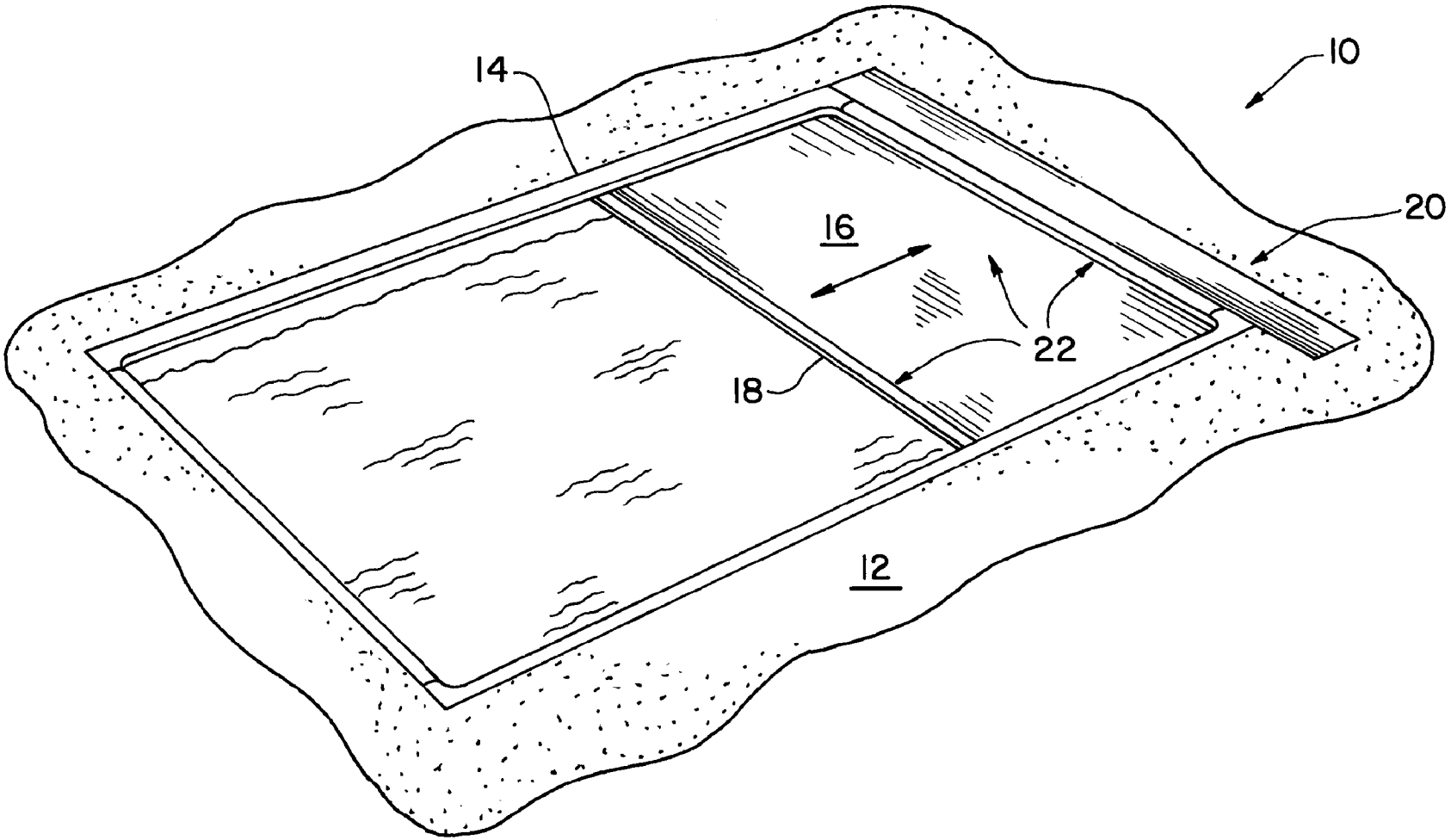
FIG. 1 is a perspective view of a swimming pool with a pool covering assembly of the present invention.

Referring now to the drawings, and more particularly to FIG. 1, there is shown an embodiment of a swimming pool 10 of the present invention which generally includes a deck 12, a coping 14, a cover 16, a leading edge bar 18 and a pool cover box 20.

Deck 12 is generally horizontal and is preferably constructed from concrete. Coping 14 connects to deck 12 in a substantially coplanar fashion along the edge of deck 12 facing the interior of swimming pool 10.

Coping 14 is connected to deck 12 and provides a track allowing leading edge bar 18 to slide therein. The general shape of the exposed portion of coping 14 is generally curved such that there are no exposed sharp corners.

Cover 16 is attached to leading edge bar 18 which pulls cover 16 from pool cover box 20, through an opening existing between pool cover box 20 and a top edge of swimming pool 10, and across the length of swimming pool 10. To prepare swimming pool 10 for use, cover 16 retracts into pool cover box 20 pulling leading edge bar 18 to the previously described opening.

Leading edge bar 18 is connected to cover 16 and provides support along the leading edge of cover 16. Each end of leading edge bar 18 is connected to at least one cable, rope, or cord (rope being the term used herein but representing any such cable, rope, cord, or the like) and is slidably connected to a track in coping 14. Leading edge bar 18 is shaped in a manner to be unobtrusive and aesthetically pleasing when located at either end of swimming pool 10. Although coping 14 is shown as including an integral track for leading edge bar 18 and cover 16, it is also possible that a pair of top mounted tracks may be mounted to deck 12 along either side of swimming pool 10.

Figure 2:
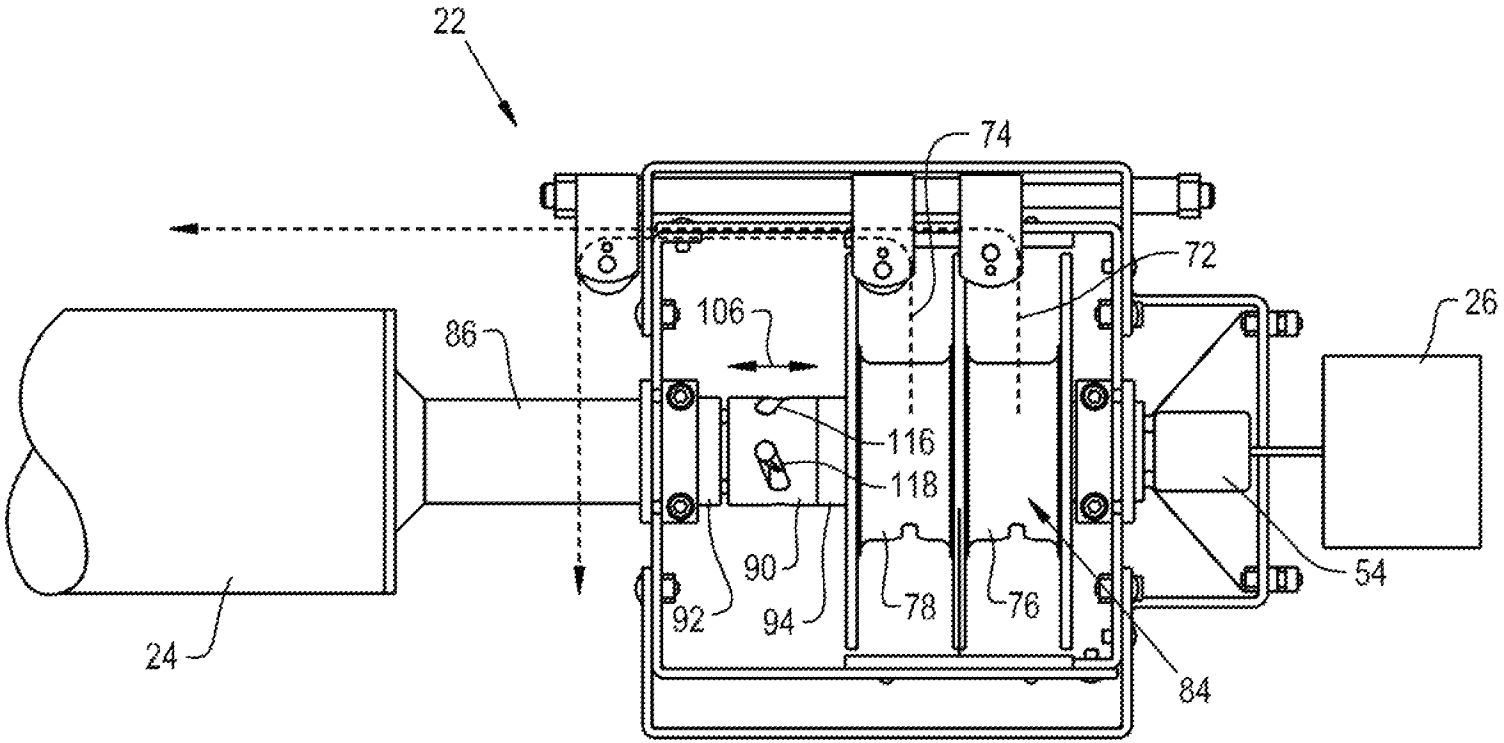
FIG. 2 is a top view of a pool covering assembly of the present invention.
Figure 3:
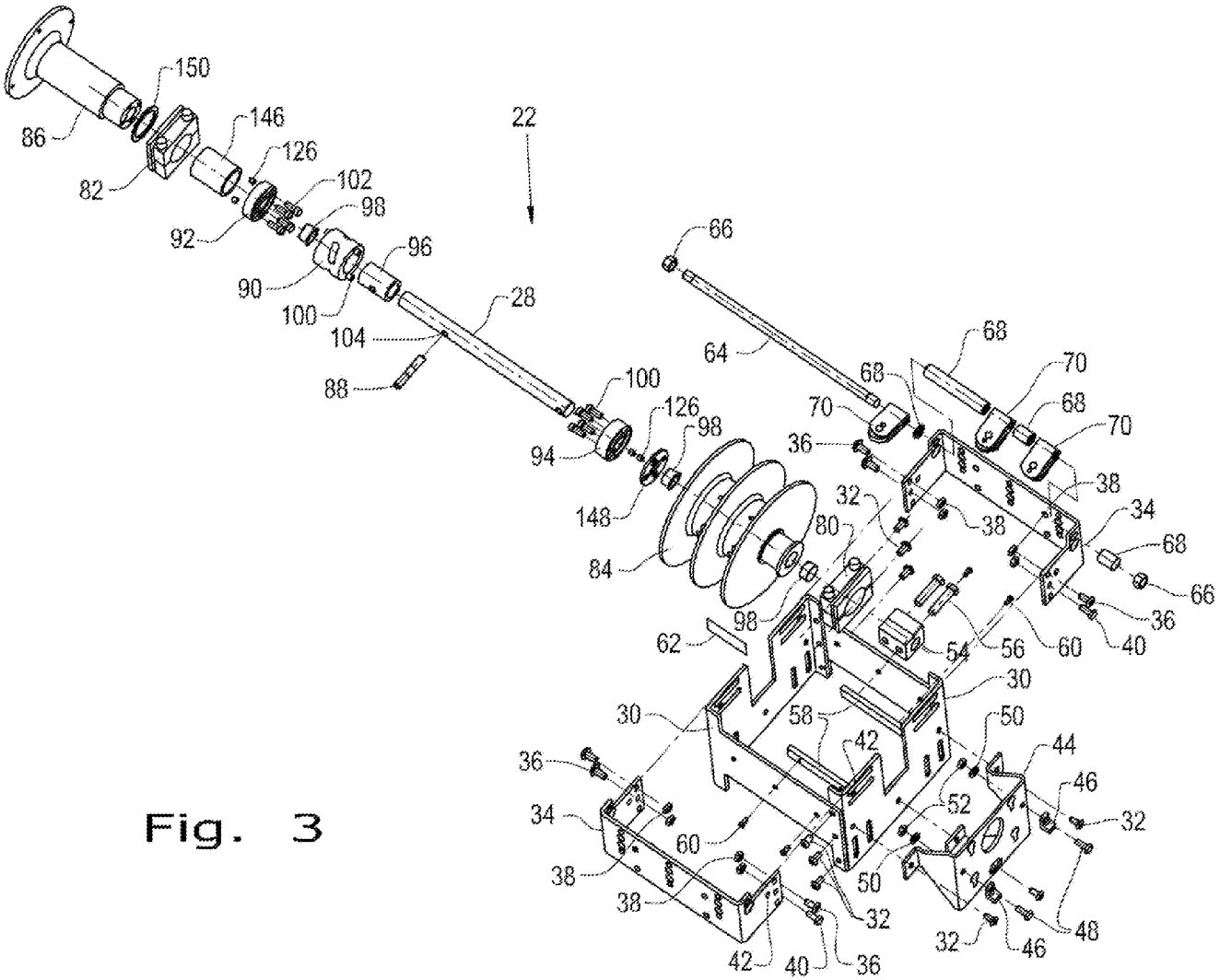
FIG. 3 is an exploded view of the pool covering assembly of FIG. 2.

Pool cover 16, leading edge bar 18, and pool cover box 20 form part of a pool cover assembly 22, which also includes a reel 24 (which can be referred to as drum 24)(drum 24 is shown schematically in FIG. 2) carried within pool cover box 20. Pool cover assembly 22 also includes a drive mechanism (discussed, at least in part, below) housed within pool cover box 20, which typically drives a rope and pulley system for the extension and retraction of cover 16 (as indicated in FIGS. 2 and 3). When cover 16 is retracted from swimming pool 10, cover 16 is wrapped around drum 24 a number of times corresponding to the length of swimming pool 10. Pool cover assembly 22 is thus for covering swimming pool 10 and thus is configured for extending cover 16 over swimming pool 10 and for retracting cover 16 from covering swimming pool 10.

FIGS. 2 and 3 show additional elements of pool cover assembly 22 (each element shown in FIGS. 2 and 3 forming a part of pool cover assembly 22). Pool cover assembly 22 can more generally be referred to herein as a cover assembly 22 for covering a container of liquid such as a swimming pool, a hot tub, a spa, a swim spa, or the like; it is understood that cover assembly 22 can be used to cover any of these containers, but the example of the cover assembly 22 discussed herein is a pool cover assembly 22 for covering a swimming pool 10. FIG. 2 schematically shows drum 24 and a motor 26 (and uses a line to schematically show their respective connection), motor 26 being used to turn a drive shaft 28. Pool cover assembly 22 further includes two brackets 30 which together form a frame and which are attached to each other by way of a plurality of rivets 32 (such as ¼ inch diameter aluminum rivets 32, this being provided by way of example and not by way of limitation). A bracket 34 forming a mounting unit is attached to one bracket 30 by way of a plurality of bolts 36 and corresponding nuts 38 (for example, a Nylock nut) and/or a plurality of screws 40 (for example, with a hex head cap) and corresponding nuts 38, and another bracket 34 is attached to the other bracket 30 in a similar manner. When attaching bracket 34 to bracket 30, square and circular holes 42 can be aligned with one another. A bracket 44 is attached to a bracket 30 by way of rivets 32, bracket 44 being a motor side bracket. Two ground lugs 46 can be attached to bracket 44 by way of corresponding screws 48 (for example, with a hex head cap), washers 50 (for example, an external tooth lock washer made with a zinc plated finish), and nuts 52 (for example, a hexagonal nut). Motor coupling 54 is mounted to drive shaft 28 adjacent bracket 44, two screws 56 extending through motor coupling 54. Opposing rope reel protectors 58 are attached respectively to brackets 30 using a plurality of screws 60 (for example, a round head Phillips). A label or nameplate 62 can be adhered to the inside of a bracket 30.

A pulley bar 64 is inserted through holes in, and attached to, one bracket 34 by way of a pair of nuts 66 (for example, a Nylock nut). Four pulley spacers 68 (two of the same size) can be used on pulley bar 64. Three pulley assemblies 70 can be placed on pulley bar 64. Each pulley assembly 70 includes a pulley housing, a pulley screw (for example, a round head Phillips), and a pulley (for example, a double bearing) for a rope (the term "rope" is used herein and includes cables, cords, or the like). The pulley screw can be positioned in one of two through-holes in the pulley housing, through a corresponding hole of the pulley, and secured by a nut (for example, a Nylock nut, not shown) on the other side of the pulley housing; FIG. 3 shows two of the pulleys being secured to the distal end (farthest away from pulley bar 64) through-hole and one of the pulleys being secured to the through-hole that is nearer to pulley bar 64. The nuts should not be over-tightened, as the pulleys must be loose. Two ropes 72, 74 are shown in broken lines in FIG. 2. Rope 72 extends from rope reel section 76 of rope reel 84 (rope 72 being attached to reel section 76 in any suitable manner), around the right-side pulley in FIG. 2, through the pulley housings of the middle and left-side pulleys in FIG. 2, to the other end (not shown) of drum 24, to the far side (other side relative to pool cover box 20) of the swimming pool 10, around another pulley, and then back to leading edge bar 18. Rope 74 extends from rope reel section 78 of rope reel 84 (rope 74 being attached to reel section 78 in any suitable manner), around the middle pulley in FIG. 2, around the left-side pulley in FIG. 2, to the far side of the swimming pool 10, around another pulley, and then back to leading edge bar 18.

Pool cover assembly 22 further includes two split bearing assemblies 80. Split bearing assemblies 80 are substantially identical to one another. Split bearing assembly 80 includes a split bearing 82 with a groove which seats within a U-shaped recess in bracket 30 to attach, at least in part, split bearing 82 to bracket 30. Split bearing assembly 80 further includes a plate secured to the bottom of split bearing 82 (on the side of the groove which is the thicker portion of split bearing 82), the plate being secured to split bearing 82 by way of a screw (for example, a round head Phillips). A pair of bolts (for example, with a hex head cap) extends upwardly from the plate (the bolt heads can be seated in a corresponding hole of plate), through split bearing 82, and out the top of split bearing 82, a corresponding compression spring and a nut (for example, a Nylock nut) being attached to the end of each bolt. Each compression spring is shown on top of the respective split bearing 82 in FIGS. 2 and 3. The springs can be preloaded by tightening the nut past the end of the bolt.

Pool cover assembly 22 further includes drive shaft 28, rope reel 84, an end casting 86 of drum 24, a drive pin 88, sleeve 146, an engagement device 90, two engagement hubs 92, 94, and a bearing 96.

Drive shaft 28 extends on one end from motor coupling 54 to the opposing end in a hole in an end casting 86 of drum 24. Drive shaft 28 is rotatably driven by motor 26 by way of motor coupling 54. A bearing can be positioned between drive shaft 28 and the end casting 86 so that drive shaft 28 and drum 24 can rotate independently of one another. In this way, drive shaft 28 extends through both split bearing assemblies 80, rope reel 84, engagement hubs 92, 94, and engagement device 90. Drive shaft 28 can rotate independently of split bearing assemblies 80, rope reel 84, and engagement hubs 92, 94 and can, in part, rotate independently of engagement device 90 (until drive pin 88 completes its travel in slots 116, 118). At least one bearing 98 can be positioned between drive shaft 28 and rope reel 74, thereby facilitating the independent rotation of drive shaft 28 relative to rope reel 84. Drive shaft 28 can be considered to include drive pin 88. Drive shaft 28 can be made of stainless steel or any other suitable material.

Rope reel 84 includes reel section 76 and reel section 78, reel section 76 being attached to and capable of being wound by rope 72, reel section 78 being attached to and capable of being would by rope 74. Rope reel 84 can be a casting and can be made of stainless steel or any other suitable material. One end of rope reel 84 extends through the axial hole in one of the split bearings 82, can rotate relative to split bearing 82, and is thereby supported by this split bearing 82. The other end of rope reel 84 is attached to engagement hub 94. This can occur, for example, by using the four screws 100 (for example, with a socket head cap) or bolts 100 shown in FIG. 3 to connect engagement hub 94 to rope reel 84.

End casting 86 of drum 24 forms one end of drum 24. A reduced diameter portion of end casting 86 is inserted through the axial hole of split bearing 82. The longitudinal end face of end casting 86 has a central hole (shown in FIG. 3) which receives a longitudinal end of drive shaft 28, as indicated above. Further, this longitudinal end face of end casting 86 has four screw holes (shown in FIG. 3) which can threadably receive four screws 102 (for example, with a socket head cap) or bolts each of which first extends through an engagement hub 92. A bearing ring 150 (made of any suitable material) can be positioned on the reduced diameter portion of end casting 86 so as to be positioned between a radial wall (extending radially to the reduced diameter portion) of end casting 86 and split ring 82.

Drive pin 88 is positioned within a through-hole 104 of drive shaft 28 (through-hole 104 being shown in FIG. 3) and thereby extends transversely relative to drive shaft 28. Drive pin 88 axially moves engagement device 90 on drive shaft 28 when drive pin 88 engages engagement device 90. Drive pin 88 can optionally have a thirty to fifty degree chamfer on the longitudinal ends of drive pin 88 (this is provided by way of example and not by way of limitation). FIG. 2 does not show drive pin 88. By way of example and not by way of limitation, drive pin 88 can be made of 316 stainless steel.

Sleeve 146 extends between split bearing 82 and rope reel 84. Sleeve 146 can be a clear plastic sleeve. More specifically, sleeve 146 can be a clear, semi-rigid, polyethylene tube with 2.05 inches inside diameter and 0.022 inches wall thickness; this material and these dimensions are provided by way of example and not by way of limitation. Components positioned within sleeve 146 include the following: engagement hub 92, engagement device 90, engagement hub 94, drive shaft 28, and drive pin 88. Drive pin 88 is in place on, and in contact with, drive shaft 28 by way of through-hole 104 in drive shaft 28. Drive pin 88 is free-floating relative to, with no press fit into, drive shaft 28 and is held in place in through-hole 104 by way of sleeve 146. Similarly, drive pin 88 is in place relative to, and in contact with, engagement device 90 by way of slots 116, 118 in engagement device 90. Drive pin 88 is free-floating relative to, with no press fit into, engagement device 90 and is held in place in slots 116, 118 by way of sleeve 146 through-hole 104. Sleeve 146 is shown in FIG. 3 but is omitted in FIG. 2 for illustrative purposes.

Figure 4:
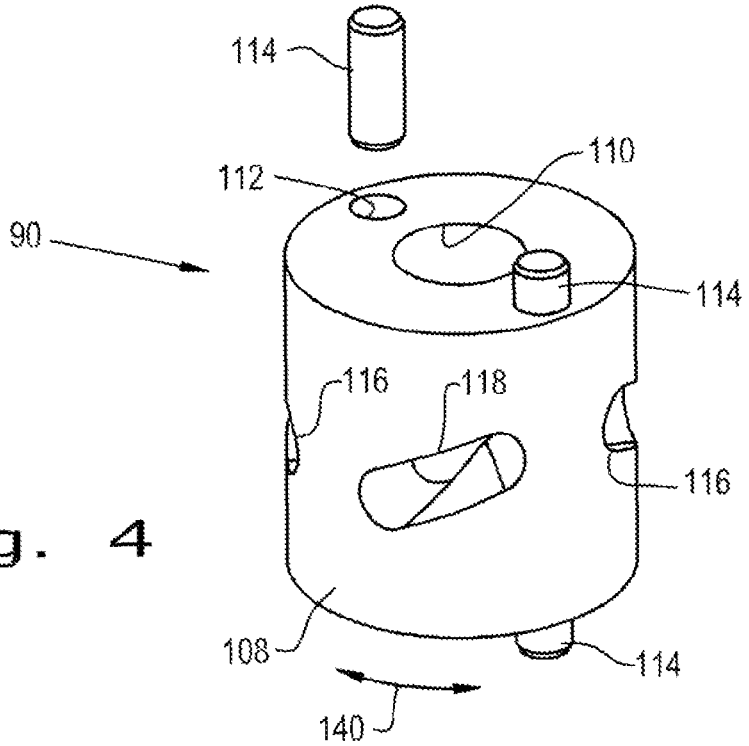
FIG. 4 is a perspective view of an engagement device of the pool covering assembly of FIG. 2.

Engagement device 90 can be referred to herein as an engagement dog 90. Engagement device 90 is configured for moving axially (in either direction, as shown by double-arrow 106) on drive shaft 28 when drive pin 88 engages engagement device 90. Engagement device 90 is configured for selectively driving each engagement hub 92, 94. Engagement dog 90 is generally formed as a cylinder and thus has a body 108 with a circular cross-section and two axial ends. Body 108 includes a centrally located axial through-hole 110 which receives drive shaft 28 therethrough. Each axial end includes two opposing blind holes 112 (positioned approximately 180 degrees apart on a respective axial end), which can, for example, be machined into the body 108. Further, each hole 112 is axially aligned with and axially opposes another hole 112 on the other axial end of body 108, as indicated by FIG. 4. By way of example and not by way of limitation, body can be made of 316 stainless steel.

As shown in FIG. 4, engagement device 90 includes at least one first engagement mechanism 114 on one axial end. Engagement device 90 can include an additional first engagement mechanism 114 axially opposing the at least one first engagement mechanism 114. Engagement dog 90 can thus include a plurality of engagement mechanisms 114, for example, four engagement mechanisms 114. Two engagement mechanisms 114 can be on each axial end and can be positioned 180 degrees from each other on a respective axial end. Further, one engagement mechanism 114 on one axial end can be axially aligned with and axially oppose another engagement mechanism 114 on the other axial end; further, the remaining engagement mechanism 114 on one axial end can be axially aligned with and axially oppose the remaining engagement mechanism 114 on the other axial end of body 108. Each first engagement mechanism 114 can be a pin 114, each of which, for example, can have a forty-five degree chamfer on the axial ends of pin 114. Each pin 114 is positioned in a corresponding blind hole 112 so that pin 114 protrudes from an axial end of body 108. Pins 114 can be seated into the entire length of blind hole 112 or only partly into the length of blind hole 112. FIG. 4 shows one pin 114 exploded from its corresponding blind hole 112. Each pin 114 can be secured to blind hole 112 by way of a press fit, an adhesive (such as silicone or any other suitable adhesive), and/or by any other suitable manner. By way of example and not by way of limitation, each pin 114 can be made of A2 tool steel. Pins 114 are configured for respectively engaging engagement hubs 92, 94, as explained below.

Figure 5:
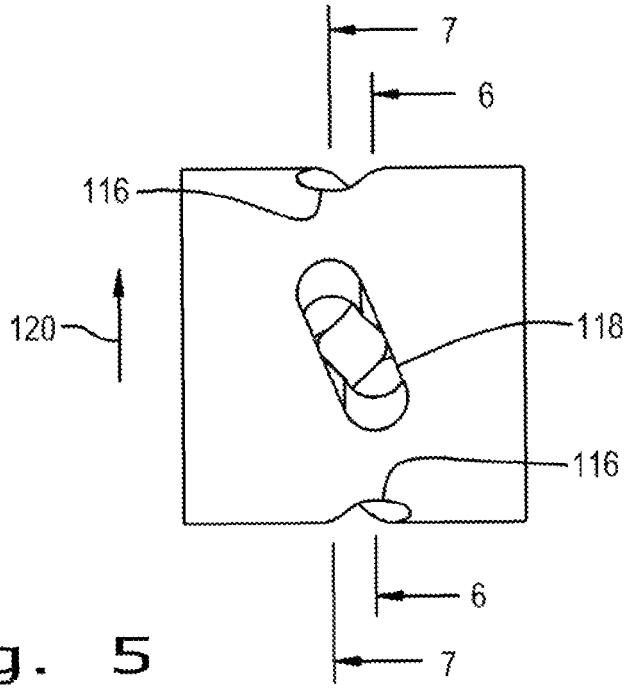
FIG. 5 is a side view of the engagement device of FIG. 4, with portions broken away.
Figure 6:
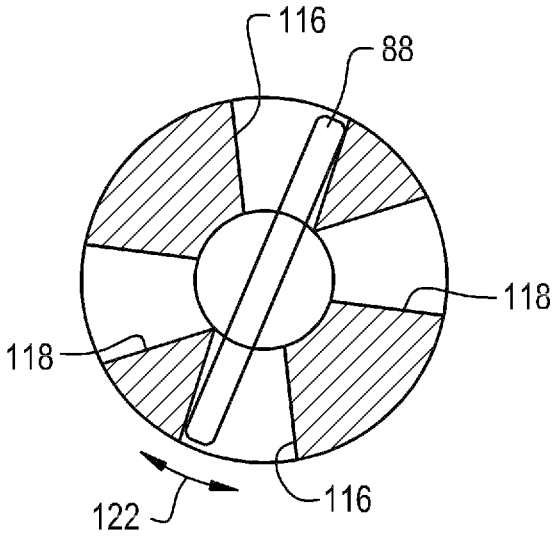
FIG. 6 is a cross-sectional view of the engagement device of FIG. 5 taken along line 6-6 of FIG. 5.
Figure 7:
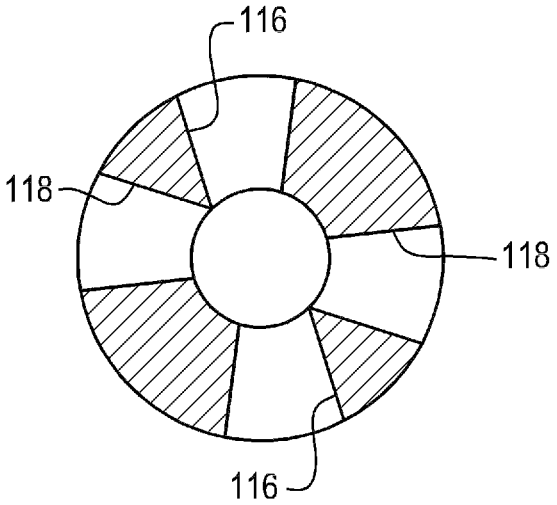
FIG. 7 is a cross-sectional view of the engagement device of FIG. 5 taken along line 7-7 of FIG. 5.

Engagement device 90 further includes a first pair of opposing slots 116 (which can be referred to as first pair of slots 116 or first slots 116) and a second pair of opposing slots 118 (which can be referred to as second pair of slots 118 or second slots 118) which are offset relative to first pair of opposing slots 116. FIGS. 4-7 show first pair of slots 116 and second pair of slots 118. FIG. 6 shows a cross-section taken along line 6-6 in FIG. 5, and FIG. 7 shows a cross-section taken along line 7-7 in FIG. 5. First pair of slots 116 and second pair of slots 118 can be, for example, machined into body 108 of engagement dog 90. FIG. 6 shows first pair of slots 116 extending substantially vertically and opposing one another by being positioned about 180 degrees from one another. FIG. 5 shows one of the slots 118 of second pair of opposing slots 118, the other slot 118 being positioned about 180 degrees around body 108 from the slot 118 that is visible in FIG. 5. Further, first pair of opposing slots 116 are offset approximately ninety degrees relative to second pair of opposing slots 118, as shown in FIGS. 4-7. Each slot 116, 118 (whether a first slot 116 or a second slot 118) is generally elliptically shaped at the exterior surface of body 108, the longitudinal ends of the ellipse moving closer to one another as the slot 116, 118 progresses into the interior of body 108 to central hole 110, the longitudinal sides of the ellipse remaining substantially parallel to one another during this progression to central hole 110. A comparison of FIGS. 6 and 7 shows how first and second slots 116, 118 change their orientation within body 108 because of their angular offset relative to a circumferential direction (shown by arrow 120 in FIG. 5) of engagement dog 90. Each slot 116 and 118 can have an angular breadth of approximately thirty-five degrees; this is provided by way of example and not by way of limitation. FIG. 3 does not show the contour of slots 116, 118. By way of example and not by way of limitation, body 108 and slots 116, 118 in body 108 can be formed by casting, molding, machining, and/or any other suitable manufacturing method.

Adjacent ones of first pair of opposing slots 116 and second pair of opposing slots 118 converge toward one another. That is, first slots 116 are oriented relative to circumferential direction 120 (shown by arrow 120 in FIG. 5) in the same way and at the same angle relative to one another; generally, in the direction of arrow 120 second slot 118 in FIG. 5 projects to the left axial end, and, in the opposite direction of arrow 120, second slot 118 projects to the right axial end. First slots 116 are also oriented relative to circumferential direction 120 in the same way and at the same angle relative to one another; generally, however, in the direction of arrow 120 first slot 116 in FIG. 5 projects to the right axial end, and, in the opposite direction of arrow 120, first slot 116 projects to the left axial end. In this way, each adjacent pair of slot2 (a first slot 116 and a second slot 118) generally form a V-shape (or an upside down V-shape), and in this way the adjacent slots (a first slot 116 and a second slot 118) can be said to converge toward one another. Thus, opposing slots (whether first slots 116 or second slots 118) are patterned on opposite sides of body 108 relative to one another. Further, slots 116, 118 are also patterned (more specifically, mirrored) on quadrants ninety degrees apart from one another. Each of the slots 116, 118 can be referred to as a diagonal cam slot.

Further, first pair of opposing slots 116 and second pair of opposing slots 118 selectively receive drive pin 88. That is, when inserting drive pin 88 in drive pin hole 104 on drive shaft 18, user (such as a pool cover installer or maintenance provider) can select whether to insert drive pin 88 in first pair of opposing slots 116 or second pair of opposing slots 118. If user chooses to insert drive pin 88 into first pair of opposing slots 116, then first pair of opposing slots 116 are aligned with drive pin hole 104 and drive pin 88 can be inserted through one first slot 116, then through drive pin hole 104, and then into the opposing first slot 116. Similarly, if user chooses to insert drive pin 88 into second pair of opposing slots 118, then second pair of opposing slots 118 are aligned with drive pin hole 104 and drive pin 88 can be inserted through one second slot 118, then through drive pin hole 104, and then into the opposing second slot 118. Drive pin 88 can be readily removed from drive pin hole 104 and first and second slots 116, 118.

FIG. 6 schematically shows drive pin 88 in a first position in slots 116 (drive pin 88 is not located body 108 in FIG. 5 but has been added to FIG. 6 for illustrative purposes). Drive pin is rotated by drive shaft in either direction, as indicated by double-arrow 122. Thus, drive pin 88 can change positions within a particular pair of slots 116, 118 when drive pin 88 is rotated by way of drive shaft 28, depending upon the direction of rotation of drive shaft 28. For example, drive pin can be rotated to a second position within the same slots 116 in FIG. 6, second position being at the other end of slots 116 (after moving drive pin 88 counter-clockwise). Pin 88 can also be selectively removed from slots 116 and placed in slots 118 so that pin 88 functions in a similar manner.

A bearing 96 can be positioned between engagement dog 90 and drive shaft 28. Bearing 96 can, for example, be press fitted and/or adhered to central hole 110 of engagement dog 90. Alternatively, bearing 96 can be connected to engagement dog 90 and/or drive shaft 28 in any suitable manner. By way of example and not by way of limitation, bearing 96 can be a nylon sleeve (white ultra-high-molecular-weight). While bearing 96 is shown in FIG. 3, bearing 96 can be omitted altogether in another embodiment of the present invention, and the diameter of the central hole 110 of engagement device 90 can be decreased so that bearing 96 fits appropriately onto drive shaft 28 (for example, the diameter of central hole 110 can be substantially similar to or slightly larger than the outside diameter of drive shaft 28).

Figure 8:
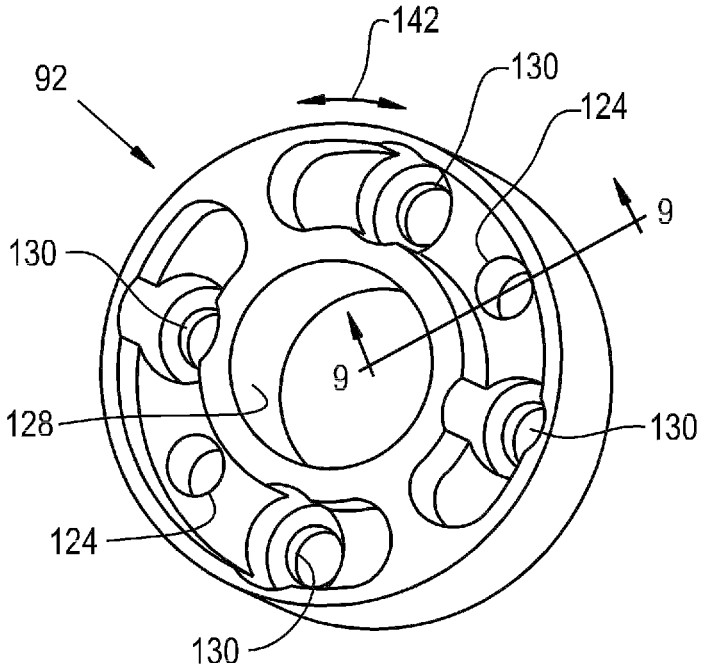
FIG. 8 is a perspective view of an engagement hub (drum side) of the pool covering assembly of FIG. 2.
Figure 9:
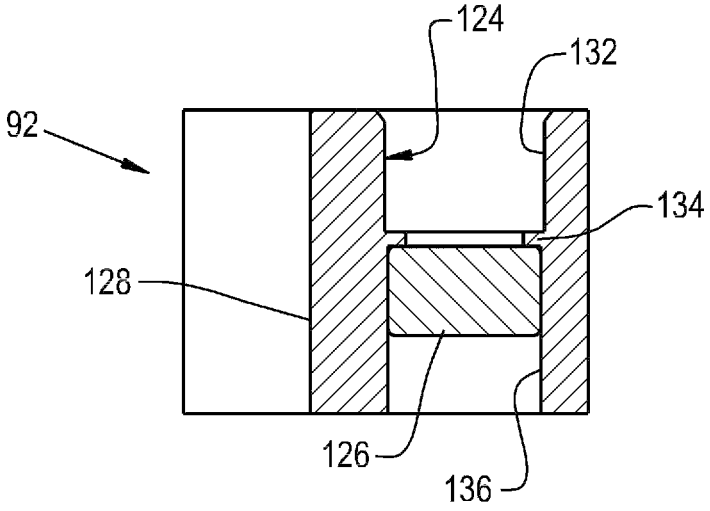
FIG. 9 is a cross-sectional view of the engagement hub (drum side) of FIG. 8 taken along line 9-9 of FIG. 8.

Engagement hub 92 is rotatably mounted to drive shaft 28 and is configured for being driven (that is, rotated in either direction on drive shaft 28, as indicated by double-arrow 142 in FIG. 8) by engagement device 90. Engagement hub 92 includes at least one second engagement mechanism 124 which includes at least one magnet 126 configured for pulling the at least one first engagement mechanism 114 (a pin 114 on the axial side of engagement dog 90 facing engagement hub 92) and thereby for facilitating an engagement of the at least one first engagement mechanism 114 with the at least one second engagement mechanism 124. Engagement hub 92 includes a central through-hole 128 for receiving drive shaft 28 therethrough. Further, a bearing 98 can be positioned between engagement hub 92 and drive shaft 28. Bearing 98 can, for example, be press fitted and/or adhered to central hole of engagement hub 92. Alternatively, bearing 98 can be connected to engagement hub 92 and/or drive shaft 28 in any suitable manner. By way of example and not by way of limitation, bearing 98 can be a nylon sleeve (white ultra-high-molecular-weight). FIG. 3 shows bearing 98 exploded from engagement hub 92. FIG. 8 shows that engagement hub 92 includes four screw holes 130 which respectively receive four screws 102, the head of each screw 102 being adjacent engagement hub 92, each screw 102 being threadably received by end casting 86 of drum 24. Engagement hub 92 is thereby axially and rotationally fixed to end casting 86 of drum 24 and thereby to drum 24. One side of engagement hub 92 (which can be a flat side) abuts split bearing 82, and the other side of engagement hub 92 faces engagement dog 90. FIG. 8 shows that engagement hub 92 includes two engagement mechanisms 124 formed as holes 124, which can be through-holes 124. FIG. 9 shows a cross-section of one of these engagement holes 124. Each engagement hole 124 has inserted therein a magnet 126. FIG. 8 does not show either magnet 126, but FIG. 9 shows the approximate positioning of one of these magnets 126 in one hole 124. Each magnet 126 can be formed as a cylinder or disc. By way of example and not by way of limitation, the material of magnet 126 can be Neodymium (NdFeB) Magnets Grade N42 Disc, 5/16 inch (diameter)×1/5 inch (thickness/length). Generally, magnet 126 can be an Earth magnet. Pin hole 124 can have three sections, 132, 134, and 136; sections 132 and 136 can have the same diameter which is larger than the diameter of section 134. Magnet 126 can be inserted into section 136 from the bottom side of hole 124 in FIG. 9 all the way to the reduced thickness portion of hole 124 (section 134). Magnet 126 can be slightly less in diameter than the diameter of hole 124 (by way of example and not by way of limitation, a 0.001 inch difference). In this way, magnet 126 can be light "press fit" (an actual hard "press fit" destroys magnet 126 by crushing) into hole 124 and adhered with silicone from the back side (from the bottom side of hole 124 shown in FIG. 9).

Figure 10:
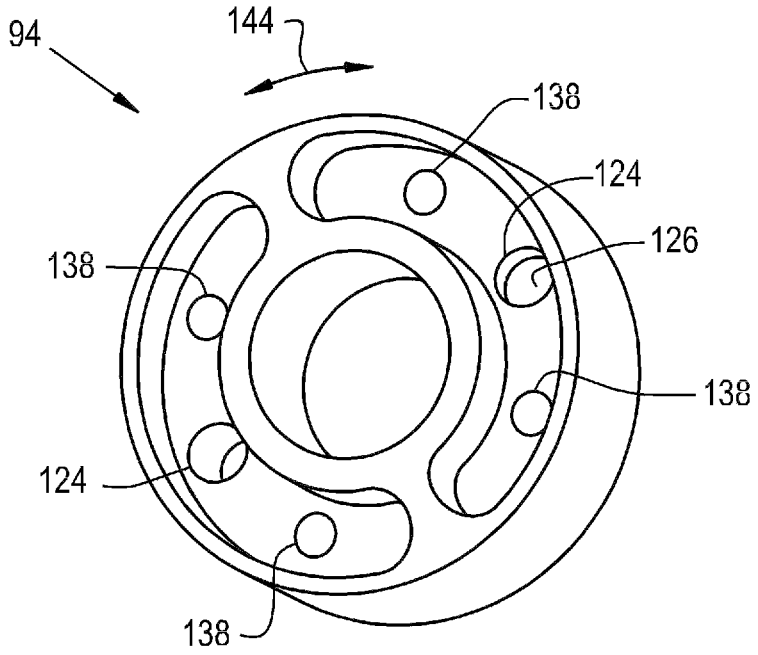
FIG. 10 is a perspective view of an engagement hub (motor side) of the pool covering assembly of FIG. 2.

Engagement hub 94 is rotatably mounted to drive shaft 28 opposite engagement hub 92 relative to engagement device 90. In other words, engagement hub 94 is on the other side of engagement dog 90 relative to engagement hub 92. Engagement hub 94 is configured for being driven (that is, rotated in either direction on drive shaft 28, as indicated by double-arrow 144 in FIG. 10) by engagement device 90. Engagement hub 94 includes at least one second engagement mechanism 124 (a hole 124) which includes at least one magnet 126 configured for pulling a first engagement mechanism 114 (a pin 114 on the axial side of engagement dog 90 facing engagement hub 94) and thereby for facilitating an engagement of this first engagement mechanism 114 with the at least one second engagement mechanism 124 (hole 124) of engagement hub 94. Engagement hub 94 includes a central through-hole 128 for receiving drive shaft 28 therethrough. Further, a bearing 98 can be positioned between engagement hub 94 and drive shaft 28; this bearing 98 can be substantially similar to bearing 98 associated with engagement hub 92 (although bearing 98 of engagement hub 94 can be longer than bearing 98 of engagement hub 92) and can, for example, be press fitted and/or adhered to central hole 128 of engagement hub 94 (alternatively, this bearing 98 can be connected to engagement hub 94 and/or drive shaft 28 in any suitable manner). FIG. 3 shows bearing 98 exploded from engagement hub 92. FIG. 10 shows that engagement hub 94 includes four screw holes 138 which respectively receive four screws 100 (screws 100 and 102 can be substantially identical), the head of each screw 100 being adjacent engagement hub 94. Engagement hub 94 is thus attached to a flange of rope reel 84 using these four screws 100 (which can be considered bolts), each screw 100 being threadably received by corresponding holes in the flange of rope reel 84. Engagement hub 94 can be attached to this flange by way of a mounting plate 148 (which can be made of stainless steel, for example), mounting plate 148 being positioned between engagement hub 94 and this flange, screws 100 also extending through corresponding holes in mounting plate 148. Engagement hub 94 can thereby be axially and rotationally fixed to rope reel 84. FIG. 10 shows that engagement hub 94 includes two engagement mechanisms 124 formed as holes 124, which can be through-holes 124. Because engagement hub 94 can be thicker than engagement hub 92, section 136 of engagement hub 94 can be longer than section 136 of engagement hub 94 (but sections 132 and 134 of holes 124 of engagement hub 94 can be substantially the same size as sections 132 and 134 of engagement holes 124 of engagement hub 92) Each engagement hole 124 of engagement hub 94 has inserted therein a magnet 126, although FIG. 10 shows only one such hole 124 having a magnet 126 therein. Each magnet 126 in engagement hub 94 can be substantially identical to magnet 126 in engagement hub 92 and can be attached to engagement hub 94 in a similar manner as magnet 126 is attached to engagement hub 92. Thus, each second engagement mechanism 124 in engagement hubs 92, 94 can be formed as a hole 124 and receive a magnet 126 fixed therein. The rear face of engagement hub 94 can have a circular cutout which is coaxial with central hole 128 but having a larger diameter than central hole 128, this cutout being formed radially inside of holes 124. Magnet 126 can be inserted in section 136 of hole 124 and be positioned adjacent section 134.

By way of example and not by way of limitation, engagement hubs 92 and 94 can be made of 316 stainless steel. By way of example and not by way of limitation, each engagement hub 92, 94 can be formed by casting, molding, machining, and/or any other suitable manufacturing method. With respect to drive pin 88, body 108 of engagement dog 90, engagement hubs 92, 94 (less magnets 126), magnets 126, and pins 114, magnets 126 and pins 114 are the only dissimilar metals. For illustrative purposes, FIG. 2 does not show mounting plate 148, bearing ring 150, or any portion of bearings 98.

Magnets 126 effect a positive engagement between pins 114 and holes 124. Section 132 of each of pin hole 124 in engagement hubs 92 and 94 can be substantially identical. Pins 114 of engagement hubs 92, 94 can, according to one embodiment of the present invention, have the same diameter as the diameter of section 132 and have almost the same length as the length of section 132 (pin being 0.002 inch shorter)(these dimensions and relative dimensions are provided by way of example and not by way of limitation). Pins 114 are inserted into section 132 of pin holes 124. When pins 114 insert in respective pin holes 124, a secure fit between pins 114 and pin holes 124 is obtained. Further, the magnetic force of respective magnets 126 help to pull (attract) the corresponding pins 114 to the corresponding pin holes 124 and to pull the pins 114 into the pin holes 124 and thereby overcome any opposing frictional force because of the dimensions of the pin holes 124 and the pins 114. In this way, magnets 126 help pins 114 to seat fully within the corresponding pin holes 124. When engagement dog 90 is perfectly centered between the four magnets 126 (in the four pin holes 124) the magnetic force of attraction on the pins 114 is theoretically equal. In other words, neither side (on the side of engagement hub 94 or engagement hub 94) has more pull than the other. However, as engagement dog 90 begins to be moved in either direction axially along drive shaft 28 by drive pin 88, then pins 114 on that side (the side of the direction of movement) of engagement dog 90 will experience a stronger magnetic force of attraction and be further urged towards that respective engagement hub 92 or 94 (for example, engagement hub 92). At the same time, however, the magnets 126 from the other engagement hub 94 (the engagement hub away from which engagement dog 90 is moving, for example, engagement hub M 94) still exert an attractive force on engagement dog pins 114 (at least on those pins 114 which are facing engagement hub 94), this force thus still pulling on engagement dog 90 and thereby resisting the movement away from engagement hub 94. This resistive force helps to allow a smoother seating of pins 114 in the pin holes 124 of engagement hub 92 (to which engagement dog 90 is axially moving). Further, this resistive force (from the magnets 126 of engagement dog 94) also helps to unseat pins 114 from the pin holes 124 when drive shaft 28 changes direction of rotation and drive pin 88 begins to move engagement dog 90 axially away from engagement dog 90. The same type of forces of attraction and resistance are experienced by engagement dog 90 (in particular, the pins 114 of engagement dog 90) as engagement dog 90 moves back to a centered position and then onward to this engagement hub 94. In this way, the presence of magnets 126 mounted in pin holes 114 provides a "sureshift" of engagement dog 90 on drive shaft 28 towards a respective engagement hub 92 or 94. In summary, this magnet technology places magnets 126 into each of engagement hubs 92, 94

(these "ends" each being a single dog) directly lined up with pins 114 in engagement dog 90 (which can be referred to as a double dog); that is, pins 114 can be directly lined up with holes 124 of both engagement hubs 92, 94 when engagement dog 90 is on drive shaft 28. When shifting, engagement hub magnets 126 pull the tool steel pins 114 in engagement dog 90, thereby creating a resistance from both sides while drive pin 88 shifts and travels through its respective slot (116 or 118) until completion. The magnets 126 make the shift (that is, the shift of drive pin 88 in respective slots 116, 118 and also the shift (axial movement) of engagement dog 90 on drive shaft 28) more precise and smoother. Further, during installation, engagement dog 90 can be installed on drive shaft 28 relative to drive pin 88 so that pins 114 are directly lined up with pin holes 124, and engagement dog 90 can be positioned between engagement hubs 92, 94 so that axial movement of engagement dog 90 in either direction almost immediately moves respective pins 114 into respective pin holes 124. In this way, a centered position of engagement dog 90 between engagement hubs can mean that pins 114 are clear of holes 124 in both hubs 92, 94. Alternatively, a centered position of engagement dog 90 between hubs 92, 94 can mean that pins 114 are positioned partially in all four holes 124 (of both hubs 92, 94) and fully seating pins 114 in holes 124 of one hub 92 or 94 means that pins 114 are finally fully released from holes 124 of the other hub 92 or 94.

The present invention, according to one embodiment, thus provides a cover assembly 22 for covering a container 10 of liquid (such as swimming pool 10 containing water). Cover assembly 22 includes: drive shaft 28 including a drive pin 88; first engagement hub 92 rotatably mounted to drive shaft 28, first engagement hub 92 including a first hole 124; and engagement device 90 configured for moving axially on drive shaft 28 when drive pin 88 engages engagement device 90, engagement device 90 including an axially extending first pin 114 which is configured for engaging first hole 124 and thereby for driving first engagement hub 92. Cover assembly 22 further includes a second engagement hub 94 rotatably mounted to drive shaft 28 opposite first engagement hub 92 relative to engagement device 90, second engagement hub 94 including a second hole 124, engagement device 90 including an axially extending second pin 114 axially opposing first pin 114, second pin 114 being configured for engaging second hole 124 and thereby for driving second engagement hub 94. Engagement device 90 includes an additional first pin 114 which is substantially parallel to first pin 114, first engagement hub 92 including an additional first hole 124, additional first pin 114 being configured for engaging additional first hole 124 and thereby for driving first engagement hub 92. Engagement device 90 includes an additional second pin 114 which is substantially parallel to second pin 114, second engagement hub 94 including an additional second hole 124, additional second pin 114 being configured for engaging additional second hole 124 and thereby for driving second engagement hub 94.

In use, a reversible motor 26 can be used to turn drive shaft 28, and thereby drive pin 88, in either direction (clockwise or counter-clockwise direction). As drive pin 88 travels within a particular slot 116, 118 (being turned by drive shaft 28, which is powered by motor 26), drive pin 88 pushes on the longitudinal side of the slot 116 or 118 and thereby causes engagement dog 90 to slide along drive shaft 28 (by way of bearing 96) in one axial direction along the longitudinal axis (through central hole 110) of engagement dog 90 (given the angular orientation of each of the slots 116, 118 relative to circumferential direction arrow 120). When drive pin 88 reaches the end of a particular slot 116, 118 (thereby completing travel of drive pin 88 within the slot 116, 118), engagement pins 114 seat within corresponding holes 124 in one of engagement hubs 92 or 94. When drive pin 88 reaches the end of the slot 116 or 118, engagement dog 90 no longer moves axially on drive shaft 28 but can rotate with, and thus in the same direction as, drive shaft 28 as drive shaft 28 continues to rotate. Rotation of engagement dog 90 causes the corresponding engagement hub 92, 94 (the engagement hub 92 or 94 which engagement dog 90 is engaging with respective engagement pins 114) to rotate. Rotation of engagement hub 92 or 94 causes either drum 24 or rope reel 84, depending upon which engagement hub 92 or 94 is engaged by engagement dog 90, to rotate. Conversely, when drive shaft 28 is reversed in its direction of rotation (by reversing the motor), then drive pin 88 is rotated and moved from one end of the slot 116 or 118 to the other end of the slot 116 or 118. As drive pin 88 travels through the slot 116 or 118, drive pin 88 pushes on another longitudinal side of the slot 116 or 118 and thereby causes engagement dog 90 to slide along drive shaft 28 (by way of bearing 96) in an opposite axial direction. When drive pin 88 reaches the end of that particular slot 116 or 118 (thereby completing travel of drive pin 88 within that slot 116 or 118), the engagement pins 114 of the other axial end of engagement dog 90 seat within corresponding holes 124 of the other engagement hub 92 or 94 (the engagement pins 114 from the opposing axial end having been released from the opposing engagement hub 92 or 94). When drive pin 88 reaches that end of the slot 116 or 118, engagement dog 90 no longer moves axially on drive shaft 28 but can rotate with drive shaft 28. Rotation of engagement dog 90 causes the corresponding engagement hub 92 or 94 to rotate. Rotation of engagement hub 92 or 94 causes the other of either drum 24 or rope reel 84 to rotate. Thus, if drive pin 88 is positioned in hole 116 in FIG. 2 (drive pin 88 is not shown in FIG. 2) and if drive shaft 28 is turned in a counter-clockwise direction (viewing drive shaft 28 from the side of motor coupling 54), then engagement dog 90 will move axially to engagement hub 94 connected to rope reel 84. Conversely, if drive shaft 28 is turned in a clockwise direction (viewing drive shaft 28 from the side of motor coupling 54), then engagement dog 90 will move axially to engagement hub 92 connected to end casting 86 of drum 24. When drive shaft 28 is turned counter-clockwise (in FIG. 2) and engagement dog 90 positively engages engagement hub 94, ropes 72 and 74 are wound onto rope reel 84 and cover 16 is thereby extended over swimming pool 10. On the other hand, when drive shaft 28 is turned clockwise and engagement dog 90 positively engages engagement hub 92, cover 16 is wound onto drum 24 and thereby retracted so that the swimming pool 10 can be used.

During installation, the installer can choose a motor-left or a motor-right orientation for the pool covering assembly 22. In a motor-left orientation, (from one perspective) motor 26 is placed at the left side of swimming pool 10 in pool cover box 20; conversely, in a motor-right orientation, (from one perspective) motor 26 is placed at the right side of swimming pool 10 in pool cover box 20. Whether one uses a motor-left orientation or a motor-right orientation can be used to determine whether drive pin 88 is positioned in first pair of slots 116 or second pair of slots 118. For example, if one considers the view shown in FIG. 2 to be a motor-right orientation (alternatively, depending upon one's perspective, this could be considered to be a motor-left orientation), then: (a) placement of drive pin 88 in first slots 116 causes engagement dog 90 to move axially to engagement hub 92 when drive shaft 28 is rotated clockwise (viewing drive shaft 28 from the side of motor coupling 54 in FIG. 2) and, conversely, to move axially to engagement hub 94 when drive shaft 28 is rotated counter-clockwise; (b) placement of drive pin 88 in second slots 118 causes engagement dog 90 to move axially to engagement hub 92 when drive shaft 28 is rotated counter-clockwise (viewing drive shaft 28 from the side of motor coupling 54 in FIG. 2) and, conversely, to move axially to engagement hub 94 when drive shaft 28 is rotated clockwise. It is likely that drive pin 88 would be placed in first slots 116 under this orientation so that cover 16 is properly retracted and extended. On the other hand, if one considers the upside-down view of FIG. 2 to be a motor-left orientation (and the pulley system (described above) is placed on the opposing bracket 34)(alternatively, depending upon one's perspective, this could be considered to be a motor-right orientation), then: (a) placement of drive pin 88 in second slots 118 causes engagement dog 90 to move axially to engagement hub 92 when drive shaft 28 is rotated counter-clockwise (viewing drive shaft 28 from the side of motor coupling 54 in FIG. 2) and, conversely, to move axially to engagement hub 94 when drive shaft 28 is rotated clockwise; (b) placement of drive pin 88 in first slots 116 causes engagement dog 90 to move axially to engagement hub 92 when drive shaft 28 is rotated clockwise (viewing drive shaft 28 from the side of motor coupling 54 in FIG. 2) and, conversely, to move axially to engagement hub 94 when drive shaft 28 is rotated counter-clockwise. It is likely that drive pin 88 would be placed in second slots 118 under this orientation so that cover 16 is properly retracted and extended. Double-arrow 140 shows that engagement dog 90 can rotate in either direction with drive shaft 28. Double-arrow 142 shows that engagement hub 92 can rotate in either direction with engagement dog 90. Double-arrow 144 shows that engagement hub 94 can rotate in either direction with engagement dog 90.

Advantageously, however, when switching between a motor-left and a motor-right orientation (or vice versa), drive pin 88 can simply be moved from one pair of slots 116 or 118 to the other pair of slots 116 or 118 and thereby avoid any confusion of the end-user with regard to which direction the motor 26 will move the cover 16 when turning the motor 26 on "forward" or "reverse" (or, "retraction" or "extension", or the like). In this way, the motor retraction switch and the motor extension switch remain oriented the same, with respect to an end-user, and the same motor 26 can be used for a motor-left and a motor-right orientation, regardless of whether a motor-left or a motor-right orientation is used. Slots 116, 118 are thus placed ninety degrees from one another to allow switching of the placement of drive pin 88 relative to engagement dog 90. Selection of one slot 116 or 118 versus the other thus allows engagement dog 90 to be used universally as a motor-right or a motor-left mechanism.

The present invention further provides a method for using a cover assembly 22 for covering a container 10 of liquid. The method includes the steps of: providing a drive shaft 28, an engagement device 90, and a first engagement hub 92, drive shaft 28 including a drive pin 88, first engagement hub 92 being rotatably mounted to drive shaft 28; moving axially engagement device 90 on drive shaft 28 when drive pin 88 engages engagement device 90, engagement device 90 including at least one first engagement mechanism 114; driving, using engagement device 90, first engagement hub 92, first engagement hub 92 including at least one second engagement mechanism 124 which includes at least one magnet 126; pulling, using at least one magnet 126, at least one first engagement mechanism 114 and thereby facilitating an engagement of at least one first engagement mechanism 114 with at least one second engagement mechanism 124. Engagement device 90 includes an additional first engagement mechanism 114 axially opposing first engagement mechanism 114, the cover assembly 22 further including a second engagement hub 94 rotatably mounted to drive shaft 28 opposite first engagement hub 92 relative to engagement device 90, the method further including driving, using engagement device 90, second engagement hub 94, first engagement hub 92 including at least one second engagement mechanism 124 which includes at least one magnet 126, the method further including pulling, using at least one magnet 126 of at least one second engagement mechanism 124 of second engagement hub 94, the additional first engagement mechanism 114 and thereby facilitating an engagement of the additional first engagement mechanism 114 with at least one second engagement mechanism 124 of second engagement hub 94. Each first engagement mechanism 114 is a pin 114 and second engagement mechanism 124 is a hole 124. Engagement device 90 includes a first pair of opposing slots 116 and a second pair of opposing slots 118 which are offset relative to first pair of opposing slots 116, first pair of opposing slots 116 and second pair of opposing slots 118 selectively receiving drive pin 88. First pair of opposing slots 116 are offset approximately ninety degrees relative to second pair of opposing slots 118. Adjacent ones of first pair of opposing slots 116 and second pair of opposing slots 118 converge toward one another.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cover assembly for covering a container of liquid, said covering assembly comprising:

a drive shaft including a drive pin;

an engagement device configured for moving axially on said drive shaft when said drive pin engages said engagement device, said engagement device including a first engagement mechanism and an additional first engagement mechanism axially opposing said first engagement mechanism;

a first engagement hub rotatably mounted to said drive shaft and configured for being driven by said engagement device, said first engagement hub including at least one second engagement mechanism which includes at least one magnet configured for pulling said at least one first engagement mechanism and thereby for facilitating an engagement of said at least one first engagement mechanism with said at least one second engagement mechanism; and a second engagement hub rotatably mounted to said drive shaft opposite said first engagement hub relative to said engagement device, said second engagement hub configured for being driven by said engagement device, said second engagement hub including at least one second engagement mechanism which includes at least one magnet configured for pulling said additional first engagement mechanism and thereby for facilitating an engagement of said additional first engagement mechanism with said at least one second engagement mechanism of said second engagement hub.

2. The cover assembly of claim 1, wherein each said first engagement mechanism is a pin and each said second engagement mechanism is a hole.

3. The cover assembly of claim 2, wherein said engagement device includes a first pair of opposing slots and a second pair of opposing slots which are offset relative to said first pair of opposing slots, said first pair of opposing slots and said second pair of opposing slots selectively receiving said drive pin.

4. The cover assembly of claim 3, wherein said first pair of opposing slots are offset approximately ninety degrees relative to said second pair of opposing slots.

5. The cover assembly of claim 4, wherein adjacent ones of said first pair of opposing slots and said second pair of opposing slots converge toward one another.

6. A cover assembly for covering a container of liquid, said covering assembly comprising:

a drive shaft including a drive pin;

a first engagement hub rotatably mounted to said drive shaft, said first engagement hub including a first hole;

an engagement device configured for moving axially on said drive shaft when said drive pin engages said engagement device, said engagement device including an axially extending first pin which is configured for engaging said first hole and thereby for driving said first engagement hub; and a second engagement hub rotatably mounted to said drive shaft opposite said first engagement hub relative to said engagement device, said second engagement hub including a second hole, said engagement device including an axially extending second pin axially opposing said first pin, said second pin being configured for engaging said second hole and thereby for driving said second engagement hub.

7. The cover assembly of claim 6, wherein said engagement device includes an additional first pin which is substantially parallel to said first pin, said first engagement hub including an additional first hole, said additional first pin being configured for engaging said additional first hole and thereby for driving said first engagement hub.

8. The cover assembly of claim 7, wherein said engagement device includes an additional second pin which is substantially parallel to said second pin, said second engagement hub including an additional second hole, said additional second pin being configured for engaging said additional second hole and thereby for driving said second engagement hub.

9. A method for using a cover assembly for covering a container of liquid, said method comprising the steps of:

providing a drive shaft, an engagement device, and a first engagement hub, said drive shaft including a drive pin, said first engagement hub being rotatably mounted to said drive shaft;

moving axially said engagement device on said drive shaft when said drive pin engages said engagement device, said engagement device including at least one first engagement mechanism;

driving, using said engagement device, said first engagement hub, said first engagement hub including at least one second engagement mechanism which includes at least one magnet;

pulling, using at least one magnet, said at least one first engagement mechanism and thereby facilitating an engagement of said at least one first engagement mechanism with said at least one second engagement mechanism.

10. The method of claim 9, wherein said engagement device includes an additional first engagement mechanism axially opposing said first engagement mechanism, the cover assembly further including a second engagement hub rotatably mounted to said drive shaft opposite said first engagement hub relative to said engagement device, the method further including driving, using said engagement device, said second engagement hub, said first engagement hub including at least one second engagement mechanism which includes at least one magnet, the method further including pulling, using said at least one magnet of said at least one second engagement mechanism of said second engagement hub, said additional first engagement mechanism and thereby facilitating an engagement of said additional first engagement mechanism with said at least one second engagement mechanism of said second engagement hub.

11. The method of claim 10, wherein each said first engagement mechanism is a pin and each said second engagement mechanism is a hole.

12. The method of claim 11, wherein said engagement device includes a first pair of opposing slots and a second pair of opposing slots which are offset relative to said first pair of opposing slots, said first pair of opposing slots and said second pair of opposing slots selectively receiving said drive pin.

13. The method of claim 12, wherein said first pair of opposing slots are offset approximately ninety degrees relative to said second pair of opposing slots.

14. The method of claim 13, wherein adjacent ones of said first pair of opposing slots and said second pair of opposing slots converge toward one another.

* * * * *